US010268138B2

(12) United States Patent
Kusunoki

(10) Patent No.: US 10,268,138 B2
(45) Date of Patent: Apr. 23, 2019

(54) FLUIDITY CORRECTION OF DEVELOPER FOR AN IMAGE FORMING APPARATUS

(71) Applicant: Konica Minolta, Inc., Chiyoda-ku, Tokyo (JP)

(72) Inventor: Takahiro Kusunoki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/879,663

(22) Filed: Jan. 25, 2018

(65) Prior Publication Data

US 2018/0217520 A1 Aug. 2, 2018

(30) Foreign Application Priority Data

Jan. 27, 2017 (JP) ..... 2017-012677

(51) Int. Cl.
*G03G 15/08* (2006.01)
*G03G 15/00* (2006.01)

(52) U.S. Cl.
CPC ..... *G03G 15/0849* (2013.01); *G03G 15/0877* (2013.01); *G03G 15/556* (2013.01); *G03G 15/0806* (2013.01); *G03G 2215/0607* (2013.01)

(58) Field of Classification Search
CPC ..... G03G 15/0848; G03G 15/0849
USPC ..... 399/27, 29, 257
See application file for complete search history.

(56) References Cited

U.S. PATENT DOCUMENTS 7,003,233 B2 * 2/2006 Matsuda et al. ... G03G 15/0849 399/27
7,346,286 B2 * 3/2008 Matsumoto et al. ..... G03G 15/0848 399/259
7,356,268 B2 * 4/2008 Itoyama ..... G03G 15/0848 399/258
9,141,027 B1 9/2015 Furuki et al.
9,335,659 B2 * 5/2016 Sakamaki ..... G03G 15/0865

FOREIGN PATENT DOCUMENTS

JP 2010091725 A 4/2010
JP 2016004193 A 1/2016

* cited by examiner

*Primary Examiner* — William J Royer
(74) *Attorney, Agent, or Firm* — Cantor Colburn LLP

(57) ABSTRACT

An image forming apparatus includes a correction amount calculator, a fluidity measuring unit, and an external additive amount calculator. The correction amount calculator calculates a correction amount of fluidity to correct the fluidity of a two-component developer. The fluidity measuring unit measures the fluidity of the two-component developer. The external additive amount calculator corrects the measured fluidity on the basis of the correction amount of fluidity, calculates the amount of an external additive of a toner from the corrected fluidity of the two-component developer, and determines the state of the external additive.

10 Claims, 12 Drawing Sheets

FIG. 5

| Standing time [hr] | Temperature and humidity | Coverage | Correction amount of fluidity [%] |
|---|---|---|---|
| 0 to 12 | LL | High | 20 |
| | | Medium | 20 |
| | | Low | 15 |
| | NN | High | 20 |
| | | Medium | 20 |
| | | Low | 15 |
| | HH | High | 15 |
| | | Medium | 15 |
| | | Low | 10 |
| 12 to 24 | LL | High | 20 |
| | | Medium | 20 |
| | | Low | 15 |
| | NN | High | 15 |
| | | Medium | 15 |
| | | Low | 10 |
| | HH | High | 10 |
| | | Medium | 10 |
| | | Low | 5 |
| 24 or longer | LL | High | 15 |
| | | Medium | 15 |
| | | Low | 10 |
| | NN | High | 5 |
| | | Medium | 0 |
| | | Low | 0 |
| | HH | High | 5 |
| | | Medium | 0 |
| | | Low | 0 |

FLUIDITY CORRECTION OF DEVELOPER FOR AN IMAGE FORMING APPARATUS

CROSS-REFERENCE TO RELATED APPLICATIONS

The present invention claims priority under 35 U.S.C. § 119 to Japanese Application No. 2017-012677, filed Jan. 27, 2017, the entire content of which is incorporated herein by reference.

BACKGROUND

Technological Field

The present invention relates to image forming apparatuses.

Description of the Related Art

A two-component developer (hereinafter also referred to as a "developer"), which is used in an image forming apparatus for the formation of an image on a sheet, mainly includes toner and a carrier. The toner includes particles to form the image on the sheet and is consumed one after another. The toner includes toner particles, and an external additive adhering onto the toner particles. Before use, the toner is mixed with the carrier in a developing device. The carrier functionally gives an appropriate electric charge to the toner via frictional electrification and conveys the toner to a developing region that faces a photoreceptor. The carrier generally includes ferrite particles coated with a resin, where the ferrite particles have magnetism, and the resin functionally imparts the electric charge to the toner.

As described above, the developer includes fine particles of various types, and the performance of the developer tends to be affected and changed by printing conditions. In particular, deterioration of the external additive is known to significantly affect the developer. The amount of the external additive in the toner (hereinafter also referred to as "external additive amount") has been expected on the basis of parameters such as the internal and external temperatures and humidity of the image forming apparatus, and the printing conditions. These conventional techniques, however, fail to expect the external additive amount accurately, because the parameters such as temperature and humidity or printing conditions are merely expected from outside of the image forming apparatus or developing unit.

Patent Literature (PTL) 1 discloses a technique of measuring the external additive amount in toner using a color identification sensor, where the toner is held back by a cleaning blade.

PTL 2 discloses a technique of evaluating how a toner layer on a developing roller is, and measuring the fluidity of the toner using a conical rotor to evaluate the fluidity of the toner.

CITATION LIST

Patent Literature

PTL 1: Japanese Unexamined Patent Application Publication (JP-A) No. 2016-4193

PTL 2: JP-A No. 2010-91725

SUMMARY

PTL 1 discloses the technique of measuring the external additive amount using a color identification sensor. This technique, however, fails to measure the external additive amount and fails to determine deterioration in performance of the external additive when the external additive is a colorless, transparent external additive.

PTL 2 discloses the measuring technique using a conical rotor. This technique, however, fails to evaluate how the external additive is, even if it can evaluate the fluidity of the toner.

If the state of the external additive changes the fluidity of the developer, the print quality is impaired. To eliminate or minimize this, demands have been made to determine the state of the external additive accurately.

The present invention has been made under these circumstances and has an object to determine, of the developer stored in the developing unit, the state of the external additive accurately.

To achieve at least one of the above-mentioned objects, an image forming apparatus reflecting an aspect of the present invention includes a developing unit, a supply unit, a fluidity measuring unit, a correction amount calculator, and an external additive amount calculator. The developing unit transfers toner contained in a two-component developer onto an image bearing member to form a toner image. The supply unit supplies the two-component developer to the developing unit. The fluidity measuring unit measures the fluidity of the two-component developer. The correction amount calculator calculates a correction amount of fluidity for correction of the fluidity of the two-component developer. The external additive amount calculator corrects the fluidity of the two-component developer on the basis of the correction amount of fluidity, where the fluidity of the two-component developer is measured by the fluidity measuring unit. In addition, the external additive amount calculator calculates an external additive amount in the toner on the basis of the corrected fluidity of the two-component developer, and determines the state of the external additive.

The present invention enables accurate determination of the state of the external additive by calculating the external additive amount in the toner on the basis of the corrected fluidity of the two-component developer.

Other and further objects, features, and advantages of the present invention will appear more fully from the detailed description given hereinbelow.

BRIEF DESCRIPTION OF THE DRAWINGS

The advantages and features provided by one or more embodiments of the present invention will become more fully understood from the detailed description given hereinbelow and the attached drawings. It is to be expressly understood, however, that the drawings are given for purpose of illustration and exemplification only and are not intended as a definition of the limits of the present invention.

FIG. 5 is a table illustrating the relationship between the printing environment and the correction amount of fluidity of the developer, in the first embodiment of the present invention;

DESCRIPTION OF EMBODIMENTS

Hereinafter one or more embodiments of the present invention will be described with reference to the attached drawings. It should be noted, however, that the disclosed embodiments are never construed to limit the scope of the present invention. In the description and the drawings, components having an approximately identical function or configuration are indicated with an identical reference sign, by which duplicate explanations are omitted.

First Embodiment

Figure 1:
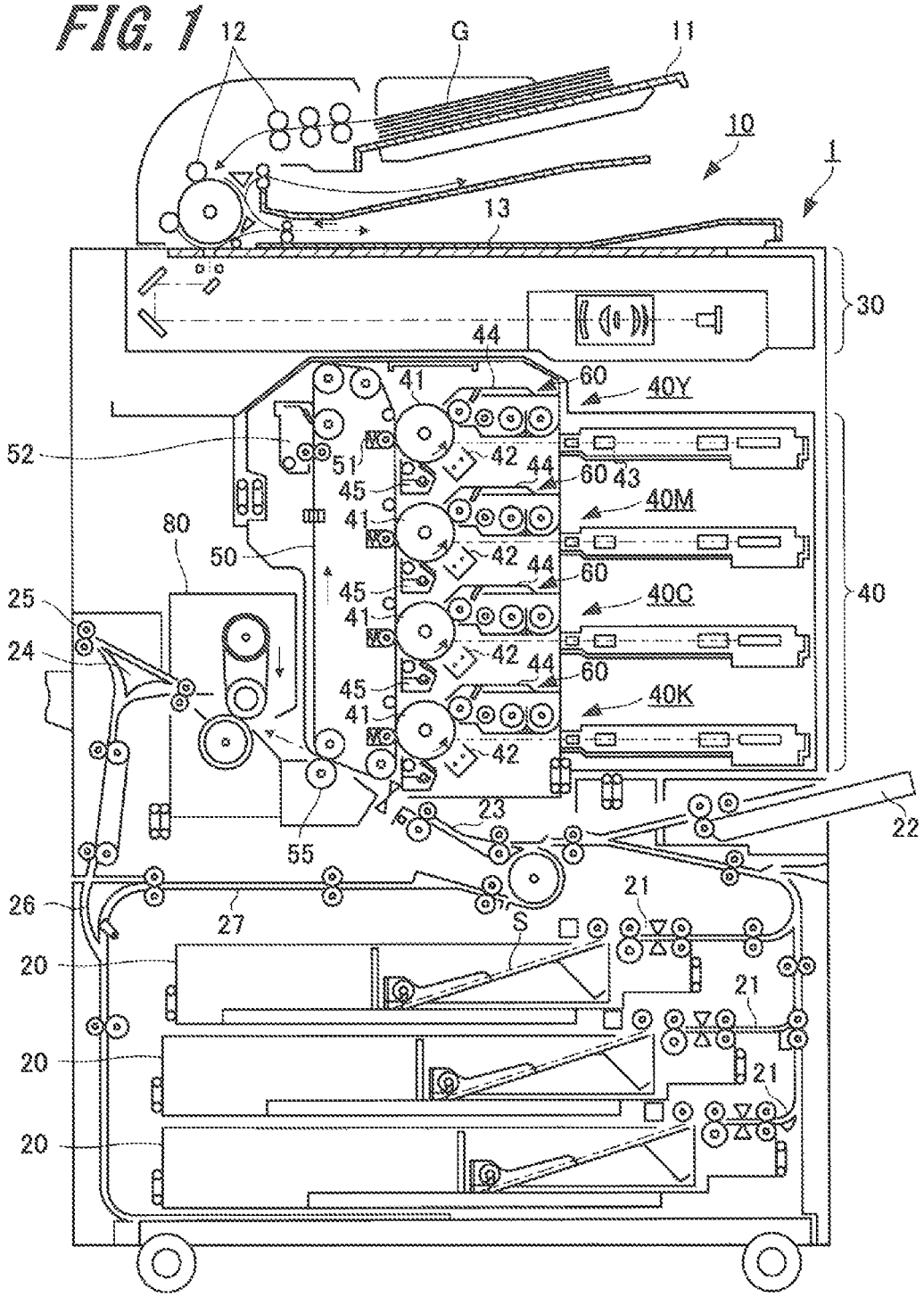
FIG. 1 illustrates an exemplary configuration of an image forming apparatus according to a first embodiment of the present invention, where the image forming apparatus structurally includes components such as an image forming section, an intermediate transfer belt, a secondary transfer unit, and a fixing unit.

FIG. 1 illustrates how components of an image forming apparatus 1 according to the first embodiment of the present invention are configured, where the components includes an image forming section 40, an intermediate transfer belt 50, a secondary transfer unit 55, and a fixing unit 80.

The image forming apparatus 1 employs an electrophotographic method to form an image on a sheet S, and is a tandem type color-image forming apparatus in which four color toners of yellow (Y), magenta (M), cyan (C) and black (Bk) are superimposed to form a color image. The image forming apparatus 1 includes an original-document feeder 10, sheet storing units 20, an image reader 30, the image forming section 40, the intermediate transfer belt 50, the secondary transfer unit 55, and the fixing unit 80.

The original-document feeder 10 includes an original-document feeding platen 11 onto which original documents G are to be set, and rollers 12. The original-documents G set on the original-document feeding platen 11 of the original-document feeder 10 are sequentially fed one by one to a reading position of the image reader 30 by the rollers 12. The image reader 30 reads an image of each original-document G fed by the original-document feeder 10 to the reading position or of an original document placed on an original-document platen 13, and generates image signals as image data.

The sheet storing units 20 are disposed in the lower portion of an apparatus main body, corresponding to various sizes of sheets S. The sheets S stored in each sheet storing unit 20 are fed one by one to a conveyor 23 by a corresponding sheet feeder 21, and further fed to the secondary transfer unit 55 by the conveyor 23, where the secondary transfer unit 55 serves as a transfer position. Specifically, the conveyor 23 has the function of feeding the sheets S, which are fed from the sheet feeder 21, to the secondary transfer unit 55 and forms a pathway for feeding the sheets S. Further, a manual insertion unit 22 is disposed at a position adjacent to the uppermost sheet storing unit 20. From the manual insertion unit 22, anyone of other sheets is fed to the transfer position through the conveyor 23. Non-limiting examples of the other sheets include a sheet having a size other than those of the sheets S stored in the sheet storing units 20; a tag sheet bearing a tag; and a special sheet such as an OHP sheet.

The image forming section 40 and the intermediate transfer belt 50 are disposed between the image reader 30 and the sheet storing units 20. The image forming section 40 includes four image forming units 40Y, 40M, 40C, and 40K, which form toner images of respective colors: yellow (Y), magenta (M), cyan (C), and black (Bk).

The first image forming unit 40Y forms the toner image of yellow, while the second image forming unit 40M forms the toner image of magenta. The third image forming unit 40C forms the toner image of cyan, while the fourth image forming unit 40K forms the toner image of black. Since the four image forming units 40Y, 40M, 40C, and 40K have the same constitution, only the first image forming unit 40Y will be described hereinafter.

The first image forming unit 40Y includes a drum-shaped photoreceptor 41; and a charging unit 42, an exposing unit 43, a developing unit 44, and a cleaning unit 45 each of which is disposed around the photoreceptor 41. The drum-shaped photoreceptor 41 serves as an image bearing member. The photoreceptor 41 is rotated counterclockwise by a driving motor (not shown). The charging unit 42 gives an electric charge to the photoreceptor 41 so as to uniformly charge the surface of the photoreceptor 41. The exposing unit 43 performs exposure scanning on the surface of the photoreceptor 41, on the basis of image data generated by the image reader 30, to thereby form an electrostatic latent image on the photoreceptor 41.

The developing unit 44 causes yellow toner to adhere onto the electrostatic latent image formed on the photoreceptor 41 as an image bearing member. As a result, a yellow toner image is formed on the photoreceptor 41. The developing unit 44 of the second image forming unit 40M causes magenta toner to adhere onto the electrostatic latent image formed on the photoreceptor 41, the developing unit 44 of the third image forming unit 40C causes cyan toner to adhere onto the electrostatic latent image formed on the photoreceptor 41, and the developing unit 44 of the fourth image forming unit 40K causes black toner to adhere onto the electrostatic latent image formed on the photoreceptor 41. According to this embodiment, each developing unit 44 of the four image forming units 40Y, 40M, 40C, and 40K is provided with a trickle system 60 which enables exchange of a developer in the developing unit 44, as illustrated in FIG.

3 described later. The external additive amount in the toner, which is developed and forms a toner image on the photoreceptor 41, is calculated on the basis of the measured fluidity of the developer, to determine the state of the external additive.

The toner adhering onto the electrostatic latent image formed on the photoreceptor 41 is transferred onto the intermediate transfer belt 50, which is taken as an example of a belt-shaped image bearing member. Thus, a toner image is formed on the intermediate transfer belt 50. The cleaning unit 45 removes the toner that remains on the photoreceptor 41 even after the toner has been transferred onto the intermediate transfer belt 50.

The intermediate transfer belt 50 is formed in an endless shape, and is rotated in a clockwise direction, opposite to the rotating direction of the photoreceptor 41, by a driving motor (not shown). Primary transferring units 51 are disposed at respective positions facing the photoreceptors 41 of the image forming units 40Y, 40M, 40C, and 40K across the intermediate transfer belt 50. Each primary transferring unit 51 applies an electric voltage, the polarity of which is opposite to that of the toner, to the intermediate transfer belt 50, and thereby the toner image formed on the photoreceptor 41 facing the primary transferring unit 51 is transferred onto the intermediate transfer belt 50.

By rotation of the intermediate transfer belt 50, toner images formed by the four image forming units 40Y, 40M, 40C, and 40K are sequentially transferred onto the intermediate transfer belt 50. As a result, toner images of yellow, magenta, cyan, and black are superimposed one upon another on the intermediate transfer belt 50, to form a color image thereon.

The secondary transfer unit 55 is disposed at a position adjacent to the intermediate transfer belt 50, downstream from the conveyor 23. The secondary transfer unit 55 is formed in a roller shape, and presses the sheet S, fed thereto by the conveyor 23, against the intermediate transfer belt 50. This transfers the color image formed on the intermediate transfer belt 50 onto the sheet S fed to the secondary transfer unit 55 by the conveyor 23. A cleaning unit 52 is disposed at a position adjacent to the intermediate transfer belt 50, downstream from the secondary transfer unit 55 in the rotating direction of the intermediate transfer belt 50, and removes the toner remaining on the intermediate transfer belt 50 after the color image has been transferred onto the sheet S. Further, the fixing unit 80 is disposed on the sheet ejection side of the secondary transfer unit 55. The fixing unit 80 applies heat and pressure to the toner image transferred onto the sheet S, so as to fix the toner image thereon.

A switching gate 24 is disposed at a position downstream from the fixing unit 80. The switching gate 24 switches the feeding path of the sheet S passed through the fixing unit 80. Specifically, in the case of a face-up (image-side upward faced) ejection mode in single-sided image formation, the switching gate 24 allows the sheet S to travel straight ahead. As a result, the sheet S is ejected by a pair of ejection rollers 25, with the image-side faced upward. On the other hand, in the case of a face-down (image-side downward faced) ejection mode in single-sided image formation or in the case of double-sided image formation, the switching gate 24 guides the sheet S downward.

In the case of the face-down ejection mode, the sheet S is guided downward by the switching gate 24 and is then reversed upward by a sheet reversing and feeding unit 26. As a result, the sheet S is ejected by the pair of ejection rollers 25, with the image-side faced downward. In the case of the both-sided image formation, the sheet S is guided downward by the switching gate 24, is then reversed upward by the sheet reversing and feeding unit 26, and is fed again to the transfer position, through a sheet re-feeding path 27.

Figure 2:
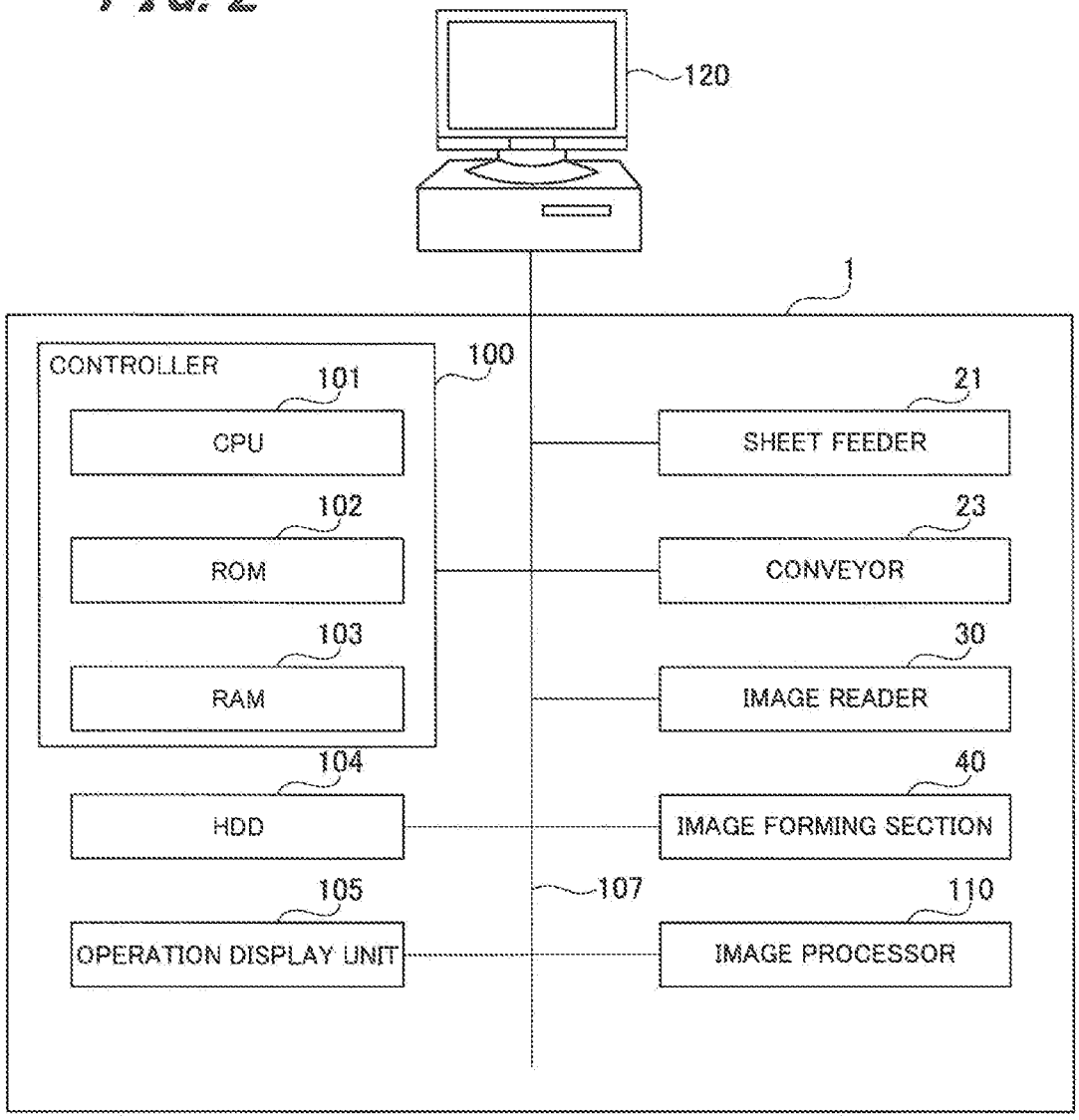
FIG. 2 is a block diagram illustrating an exemplary configuration of a control system of the image forming apparatus according to the first embodiment of the present invention.

FIG. 2 is a block diagram illustrating an exemplary configuration of a control system of the image forming apparatus 1.

For example, the image forming apparatus 1 includes a central processing unit (CPU) 101; a read only memory (ROM) 102 to store, for example, programs to be executed by the CPU 101; and a random access memory (RAM) 103 used as a working area of the CPU 101. The image forming apparatus 1 further includes a hard disk drive (HDD) 104 as a large-capacity storage device, and an operation display unit 105. In general, an electrically erasable programmable ROM is employed as the ROM 102.

A controller 100 of the image forming apparatus 1 includes the CPU 101, the ROM 102, and the RAM 103, is coupled respectively to the HDD 104 and the operation display unit 105 through a system bus 107, and controls the image forming apparatus 1 entirely. In addition, the controller 100 is coupled to the sheet feeder 21, the conveyor 23, the image reader 30, the image forming section 40, and an image processor 110, through the system bus 107.

The HDD 104 stores image data of an image of an original-document, obtained by reading the image of the original-document with the image reader 30. The HDD 104 also stores any other data such as already output image data. The HDD 104 is employed as an example of a non-transitory computer-readable storage medium storing a program to be executed by the CPU 101. The non-transitory computer-readable storage medium is not limited to the HDD 104, but may be any of other storage media such as CD-ROM and DVD-ROM.

The operation display unit 105 is a touch screen including a display, such as a liquid crystal display (LCD) or an organic electro-luminescence display (organic ELD). The operation display unit 105 displays, for example, instruction menus for the user, and information regarding acquired image data. Further, the operation display unit 105 is provided with keys, and accepts inputting of various instructions, and data such as characters and numerals, through the key operations by the user.

The image reader 30 optically reads an image of the original-document, and converts the image into electric signals as image data. For example, in the case of reading an image of a color original-document, the image reader 30 generates image data including 10 bits luminance information per pixel for each of red (R), green (G), blue (B). Image data generated by the image reader 30 or transmitted from a personal computer (PC) 120 is transmitted to the image processor 110, and is subjected to image processing, where the PC 120 is taken as an example of an external device coupled to the image forming apparatus 1. The image processor 110 applies various kinds of processing to the received image data, according to necessity. Non-limiting examples of the processing include shading correction, image density adjustment, and image compression.

For example, when color image formation is performed in the image forming apparatus 1, RGB image data, generated typically by the image reader 30, are input into a color conversion look up table (LUT) in the image processor 110, and are color-converted into image data of Y, M, C, and Bk. Successively, the image processor 110 further applies processing to the color-converted image data. Non-limiting examples of the processing include correcting gradation reproduction characteristics, screen processing typically of halftone dots by referring to a density correction LUT, and edge processing for emphasizing fine lines.

In the present embodiment, an example employing the PC 120 as the external device has been described, but the scope of the external device is not limited to the personal computer. Various other kinds of devices such as a facsimile device can be employed as the external device.

The image forming section 40 receives image data processed by the image processor 110, and on the basis of the received image data, forms an image on the sheet S.

Figure 3:
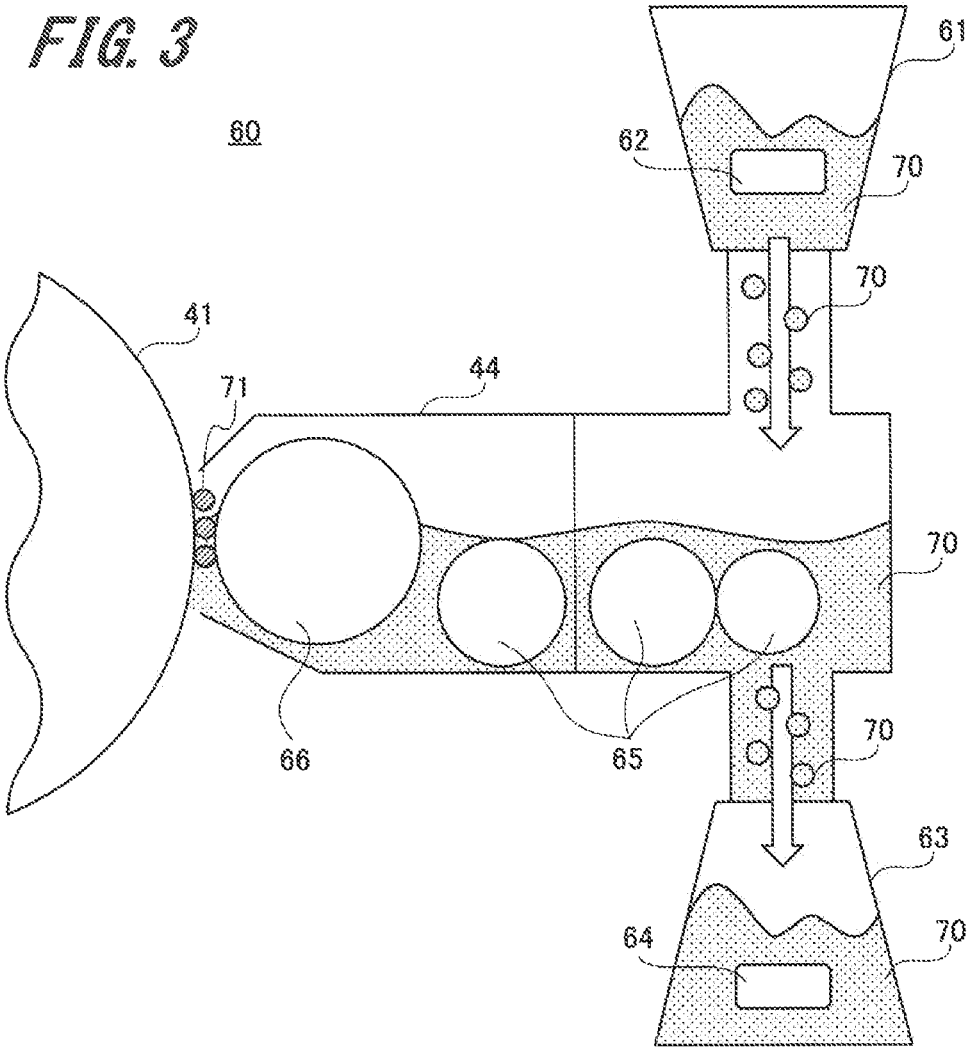
FIG. 3 illustrates an exemplary configuration of a trickle system according to the first embodiment of the present invention.

FIG. 3 illustrates an exemplary configuration of the trickle system 60.

The trickle system 60 is provided for each of the developing units 44 of yellow (Y), magenta (M), cyan (C), and black (Bk), supplies a developer 70 (as an example of the two-component developer) to the developing units 44, and discards the developer 70 after use in the developing units 44. Herein an exemplary configuration of the trickle system 60 which is provided in the developing unit 44 of yellow (Y) will be described.

In addition to the developing unit 44, the trickle system 60 includes a supply unit 61 and a discarding unit 63. The supply unit 61 is disposed upstream from the developing unit 44 and supplies the developer 70 to the developing unit 44. The discarding unit 63 is disposed downstream from the developing unit 44 and stores the developer 70 discarded from the developing unit 44. The supply unit 61 and the discarding unit 63 are attached to the developing unit 44 to thereby constitute the trickle system 60, which enables periodical exchange of the developer 70 to be used in the developing unit 44.

The supply unit 61 is provided with a supplied-developer fluidity measuring unit 62 that measures the fluidity of the developer 70 stored in the supply unit 61. The discarding unit 63 is provided with a discarded-developer fluidity measuring unit 64 that measures the fluidity of the developer 70 discarded from the developing unit 44.

The developer 70 is periodically added to the supply unit 61, and is supplied along the down arrow to the developing unit 44. The supplied-developer fluidity measuring unit 62 measures the fluidity of the developer 70 stored in the supply unit 61. Not the entire developer 70, but toner 71 alone may be stored in the supply unit 61. In this case, the supplied-developer fluidity measuring unit 62 measures the fluidity of the toner 71 stored in the supply unit 61 as a fluidity of the isolated toner 71.

The developing unit 44 stores the developer 70 supplied in a predetermined amount from the supply unit 61. The developer 70 includes the toner 71 and the carrier (not shown), as described above. The toner 71, when adhering onto the photoreceptor 41, forms a toner image by developing a latent image. The developing unit 44 is provided with supply rollers 65 and a developing roller 66. In the developing unit 44, the supply rollers 65 are rotary driven, thereby cause the toner 71 to undergo frictional electrification, and cause the carrier bearing the toner 71 to move toward the developing roller 66. The developer 70 then adheres onto the developing roller 66 to which a high voltage is applied. The carrier adhering onto the developing roller 66 bears the toner 71, which is charged with polarity opposite to that of the carrier. When a developing bias is applied to the developing roller 66, the toner 71 flies from the developing roller 66 onto the photoreceptor 41 and forms a toner image thereon.

The carrier adhering onto the developing roller 66 is repeatedly used so as to allow the toner 71 to fly onto the photoreceptor 41. Thus, the carrier repeatedly comes in contact with the toner 71 in the developing unit 44, thereby repeatedly receives heat and/or pressure, and becomes susceptible to distortion or deformation in its surface. If the carrier surface is distorted, the toner 71 may fail to adhere to the carrier sufficiently, and this may impede the formation of a toner image on the photoreceptor 41 with a sufficient amount of the toner 71. This results in deterioration in print quality. To eliminate or minimize this, it is important to determine the state of the developer 70 to be used in the developing unit 44.

The discarding unit 63 stores the developer 70 discarded from the developing unit 44. Also this developer 70 moves along the down arrow from the developing unit 44 to the discarding unit 63. The discarded-developer fluidity measuring unit 64 measures the fluidity of the developer 70 stored in the discarding unit 63.

The supplied-developer fluidity measuring unit 62 and discarded-developer fluidity measuring unit 64 determine the fluidity typically on the basis of the developer amount measured by the following first or second method.

The first method is the method of measuring the amount of the developer 70 traveling by a unit distance using an optical sensor or a magnetic sensor. With this method, it is possible to determine that the developer 70 has high fluidity when the developer amount is large; and that the developer 70 has low fluidity when the developer amount is small.

The second method is the method of measuring the weight of the developer 70 discharged from the developing unit 44, and measuring the developer amount on the basis of the weight of the developer 70. With this method, it is possible to determine that the developer 70 has high fluidity when the weight of the developer is high; and that the developer 70 has low fluidity when the weight of the developer is low.

However, the fluidity of the developer 70 may be measured by another method than the first and second methods.

Thereafter the state of the developer 70 is determined on the basis of the fluidity of the developer 70. An exemplary way to determine the state of the developer 70 will be illustrated below.

Figure 4:
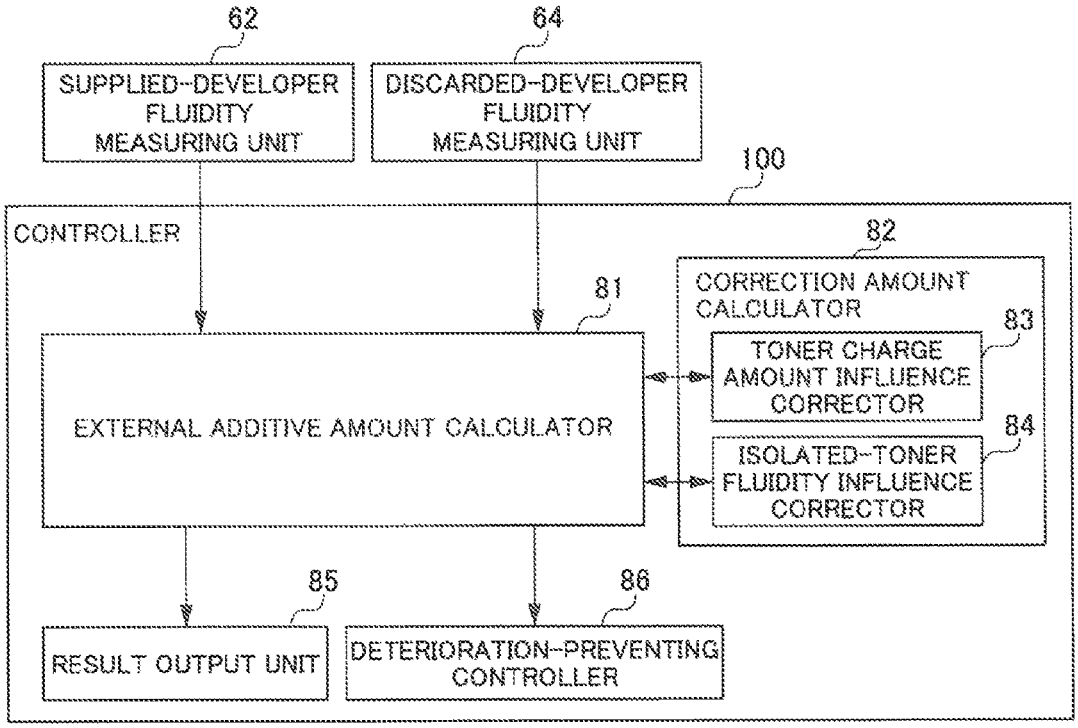
FIG. 4 is a block diagram illustrating an exemplary internal configuration of the controller according to the first embodiment of the present invention.

FIG. 4 is a block diagram illustrating an exemplary internal configuration of the controller 100.

The controller 100 includes an external additive amount calculator 81, a correction amount calculator 82, a result output unit 85, and a deterioration-preventing controller 86.

The external additive amount calculator 81 calculates the external additive amount in the toner 71 to be developed by the developing unit 44, on the basis of the relationship between the fluidity of the developer 70 and the external additive amount, where the fluidity is measured by discarded-developer fluidity measuring unit 64. In this process, the external additive amount calculator 81 corrects the fluidity of the developer 70 on the basis of the correction amount of fluidity, where the "correction amount of fluidity" refers to the correction amount of the fluidity of the developer 70. The correction amount of fluidity of the developer 70 is a value determined by the correction amount calculator 82.

However, the external additive amount calculator 81 can also calculate the external additive amount on the basis of not only the fluidity of the developer 70 measured by the discarded-developer fluidity measuring unit 64, but also the fluidity of the developer 70 or toner 71 measured by the supplied-developer fluidity measuring unit 62. In this case, the external additive amount calculator 81 corrects the fluidity of the developer 70 by the correction amount of fluidity, which is calculated by the isolated-toner fluidity influence corrector 84 on the basis of the fluidity of the developer 70 or of the isolated toner 71, stored in the supply unit 61.

The correction amount calculator 82 calculates a correction amount of fluidity in accordance with any of: the charge amount of the toner 71, the printing environment of the developer 70, the developing bias to be applied to the photoreceptor 41, and the fluidity of the developer 70 or the toner 71 stored in the supply unit 61. The correction amount of fluidity is used for the correction of the influence of the printing environment and/or the printing conditions on the fluidity of the developer 70. The correction amount calculator 82 includes a toner charge amount influence corrector 83 and the isolated-toner fluidity influence corrector 84.

The toner charge amount influence corrector 83 corrects the influence of the charge amount of the toner 71 discarded to the discarding unit 63, on the fluidity of the developer 70.

When the toner 71 alone is stored in the supply unit 61, the isolated-toner fluidity influence corrector 84 corrects the influence of the fluidity of the isolated toner 71, as measured by the supplied-developer fluidity measuring unit 62, on the fluidity of the developer 70.

Figure 7:
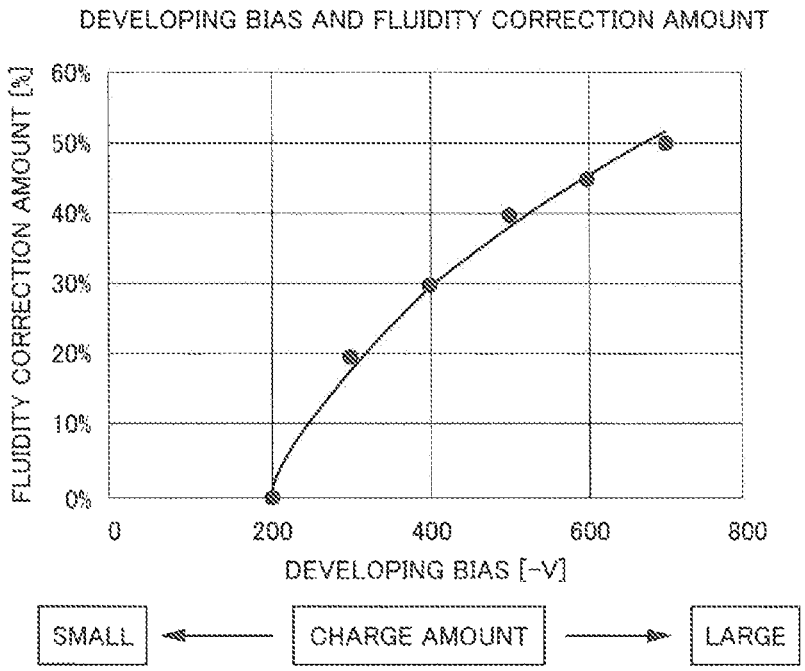
FIG. 7 is a graph illustrating the relationship between the developing bias and the correction amount of fluidity in the first embodiment of the present invention.

Then, the external additive amount calculator 81 calculates the state of the external additive in the toner 71 by correcting the fluidity of the developer 70 by the predetermined correction amount of fluidity, where the fluidity of the developer 70 has been corrected in the influence of the charge amount of the toner 71 and the fluidity of the isolated toner 71. The correction amount of fluidity may be a preset one, as illustrated in FIG. 5 and FIG. 7 below. Thus, the external additive amount calculator 81 can determine, for example, the external additive amount and/or the external additive performance as the state of the external additive.

The result output unit 85 outputs the result indicating the state of the external additive, as determined by the external additive amount calculator 81. The result is indicated typically on the screen of the PC 120.

The deterioration-preventing controller 86 performs control according to the printing environment and printing conditions, so as to eliminate or minimize deterioration in print quality, where the control is performed on the basis of the state of the external additive in the toner 71, determined by the external additive amount calculator 81. If the external additive amount and/or the external additive performance decreases, the quality of printing using the toner 71 deteriorates. Non-limiting examples of the printing environment include the internal and external temperatures and humidity of the image forming apparatus 1 itself; and the standing time and coverage of the developer 70. The correction amount of fluidity varies depending on the printing environment, as illustrated in FIG. 5 described below. Non-limiting examples of the printing conditions include controlling values (such as developing bias) for the amount of the toner 71 to adhere to the photoreceptor 41.

The "standing time" given in FIG. 5 represents, for example, a time period during which the power of the image forming apparatus 1 is OFF, and the developing unit 44 is not driven. The standing time is set as 0 to 12 hours, 12 to 24 hours, and 24 hours or longer. A standing time of 0 hour is a time point immediately after the power of the image forming apparatus 1 is turned OFF. A standing time of 0 to 12 hours refers to a standing time of from 0 hour to shorter than 12 hours; and a standing time of 12 to 24 hours refers to a standing time of from 12 hours to shorter than 24 hours.

The "temperature and humidity" represents, for example, the temperature and humidity in the room where the image forming apparatus 1 is placed, or inside of the image forming apparatus 1. For example, HH indicates that the temperature is 30° C., and the humidity is 80%; NN indicates that the temperature is 20° C., and the humidity is 50%; and LL indicates that the temperature is 10° C., and the humidity is 10%.

The "coverage" is an index used as an example of the printing conditions and represents the amount (%) of the toner 71 to be used per sheet typically of A4 size. When the entire A4 sheet is printed black, the coverage of the black toner 71 is defined as 100%. When the entire A4 sheet remains blank without being covered by the black toner, the coverage of the black toner 71 is defined as 0%.

The state of the external additive in the toner 71, if deteriorates, causes various deterioration in quality and functions. For example, assume that the external additive decreases in amount, or the surface of the external additive is distorted, and thereby the state of the external additive deteriorates. In this case, the toner 71 has a higher adhesive strength and remains as adhering to the photoreceptor 41 upon transfer; and is transferred at a lower transfer rate from the photoreceptor 41 to the intermediate transfer belt 50. To eliminate or minimize this, the deterioration-preventing controller 86 starts up control to improve the transfer rate in accordance with the state of the external additive. The control to improve the transfer rate refers typically to such a control that the deterioration-preventing controller 86 increases the voltage to be applied to the intermediate transfer belt 50 to thereby increase the transfer rate of the toner 71.

The fluidity of the developer 70 is affected by the charge amount of the toner 71. For example, with an increased charge amount of the toner 71, the resistance between the toner 71 and the carrier increases, and the fluidity of the developer 70 decreases. The external additive amount calculator 81 corrects the changed portion of the fluidity of the developer 70 as changed by the charge amount of the toner 71, so as to improve the precision of the calculation of the external additive amount. Non-limiting examples of methods for correcting the fluidity of the developer 70 include a "method of correcting the measured fluidity"; and a "method of correcting or calibrating a graph illustrating the relationship between the fluidity and the external additive amount". Hereinafter the method of correcting the measured fluidity of the developer 70 will be described.

The measured fluidity is a value determined according to Expression (1) below, and is also referred to as "fluidity" in the following description. In Expression (1), the toner charge amount represents a value indicating the charge amount of the toner 71, as determined from the printing environment and/or the printing condition of the developer 70 to be stored in the discarding unit 63. The isolated-toner fluidity represents a value indicating the fluidity of the toner 71, as determined by the supplied-developer fluidity measuring unit 62 when the toner 71 alone is stored in the supply unit 61. For example, the developer 70 is supplied immediately after the image forming apparatus 1 starts up; and the toner 71 alone is supplied after elapse of a predetermined time. Both the toner charge amount and the isolated-toner fluidity affect the measured fluidity of the discarded developer.

$$\text{Measured fluidity of discarded developer} = (\text{External additive state}) + (\text{Toner charge amount}) + (\text{Isolated-toner fluidity}) \quad (1)$$

The external additive amount calculator 81 can determine the state of the external additive in the toner 71 by subtracting the toner charge amount and the isolated-toner fluidity from the measured fluidity of the discarded developer according to following Expression (2), which is a modification of Expression (1).

External additive state=(Measured fluidity of discarded developer)−(Toner charge amount)−(Isolated-toner fluidity) (2)

Examples of the external additive state include the external additive amount and the external additive performance, as described above. To determine the external additive amount or the external additive performance, the external additive amount or the external additive performance may be substituted for the external additive state in Expressions (1) and (2).

Hereinafter two methods (first and second methods) for the external additive amount calculator 81 to calculate the external additive amount from the fluidity of the developer 70 will be described.

The first method is a method of determining the correction amount of fluidity on the basis of the table given in FIG. 5, and calculating the external additive amount according to the correction amount of fluidity. The second method is a method of determining the correction amount of fluidity on the basis of the developing bias given in FIG. 7, and calculating the external additive amount according to the correction amount of fluidity.

First Method for Calculating External Additive Amount

Initially, the first method for calculating the external additive amount will be described with reference to FIG. 5 and FIG. 6.

FIG. 5 is a table illustrating the relationship between the printing environment and the correction amount of the fluidity of the developer 70.

The table includes fields of standing time, temperature and humidity, and coverage, each of which indicates the printing environment; and a field of correction amount of fluidity. The table presents correction amounts of the fluidity of the developer 70 corresponding to the printing environment (standing time of the developer 70, temperature and humidity, and coverage), where the charge amount of the toner 71 varies depending on the printing environment.

The external additive amount calculator 81 calculates the correction amount of the fluidity of the developer 70 according to the printing environment of the developer 70 and corrects the fluidity of the developer 70 by the correction amount of fluidity. The external additive amount calculator 81 then calculates the external additive amount using the relationship between the corrected fluidity of the developer 70 and the external additive amount in the toner 71, to determine the state of the external additive.

For example, when the coverage is low, only a small amount of the toner 71 is used. This causes the developer 70 to reside in the developing unit 44 for a longer time period and to be susceptible to deterioration. Such deterioration of the developer 70 causes the toner 71 to resist charging. The toner 71, if resisting charging, more weakly attracts the carrier, and this reduces the frictional resistance between the developer 70, and causes the developer 70 to have higher fluidity. In contrast, when the coverage is high, a large amount of the toner 71 is used. This causes the developer 70 to reside in the developing unit 44 for a shorter time period and allows the developer 70 to be replaced with fresh one at frequent intervals. This restrains deterioration of the developer 70. The developer 70, when not deteriorating, allows the toner to be readily charged. However, the toner 71, when being readily charged, attracts the carrier more strongly, and this causes the developer 70 to have higher frictional resistance between particles of itself and to have lower fluidity.

The correction amount of fluidity is used for the correction of the measured fluidity of the developer 70, which varies depending on the external additive amount and the charge amount of the toner 71. For example, the developer 70, when having low fluidity, tends to be solidified, and the fluidity should be corrected by a large amount. In contrast, the developer 70, when having high fluidity, resists solidification, and the fluidity may be corrected by a small amount.

For example, as demonstrated in the table in FIG. 5, when the standing time is 0 to 12 hours, and the temperature and humidity are LL or NN, the correction amounts of fluidity are 20%, 20%, and 15% respectively at high, medium, and low coverages. The table indicates that the toner 71 can more readily maintain its charged state with a short standing time, and this requires a larger correction amount of fluidity of the developer 70.

When the standing time is 0 to 12 hours and the temperature and humidity are HH, the correction amounts of fluidity are 15%, 15%, and 10% respectively at high, medium, and low coverages. Accordingly, when the temperature and humidity are HH, the toner 71 more resists charging, and this requires smaller correction amounts of fluidity at high, medium, and low coverages, as compared with the cases where temperature and humidity are LL or NN.

However, when the standing time is 24 hours or longer, the toner 71 discharges, and the developer 70 has high fluidity. Accordingly, the correction amounts of fluidity corresponding to the temperature and humidity of LL, NN, and HH and corresponding to high, medium, and low coverages are smaller as compared with the cases where the standing time is 0 to 12 hours, and 12 to 24 hours. Thus, the correction amount of fluidity is large under conditions at a large charge amount of the toner 71, whereas the correction amount of fluidity is small under conditions at a small charge amount of the toner 71. When the coverage is high, the toner 71 is charged in a large amount, and this requires a large correction amount of fluidity; whereas, when the coverage is low, the toner 71 is changed in a small amount, and this requires a smaller correction amount of fluidity.

Relationship between Developer Fluidity and External Additive Amount

Figure 6:
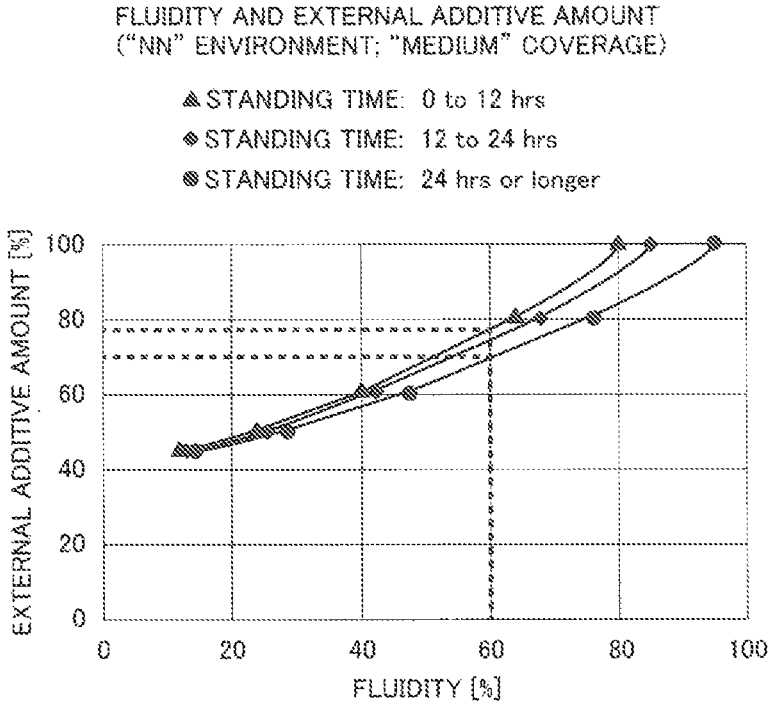
FIG. 6 is a graph illustrating the relationship between the external additive amount and the fluidity of the developer, in the first embodiment of the present invention, where the relationship varies depending on the standing time of the developer.

FIG. 6 is a graph illustrating the relationship between the fluidity of the developer 70 and the external additive amount, where the relationship varies depending on the standing time. The graph is plotted with the abscissa indicating the fluidity of the developer 70 (%), and the ordinate indicating the external additive amount (%).

FIG. 6 illustrates relationships between the fluidity of the developer 70 and the external additive amount, typically when the internal environment of the developing unit 44 is NN, and the coverage is "medium", at standing times of 0 to 12 hours, 12 to 24 hours, and 24 hours or longer. For example, an external additive amount of 60% indicates that the external additive amount, which is 100% upon production of the developer 70, decreases down to 60%.

As described above, the developer 70, when having a fluidity close to 0%, resists flowing; whereas the developer 70, when having a fluidity close to 100%, tends to very easily flow. The toner 71, when having an external additive amount close to 0%, is found to contain almost no external additive; whereas the toner 71, when having an external additive amount close to 100%, is found to contain a sufficient amount of the external additive. The external additive amount is calculated according to following Expression (3), on the basis of the relationship between the fluidity of the developer 70 and the external additive amount. FIG. 6 is a graph plotted according to Expression (3). Expression (3) indicates that the external additive amount is determined by subtracting or removing the influence of the toner charge amount from the measured fluidity of the developer 70, as indicated by Expression (2).

$$\text{External additive amount}=a1\times\exp(b1\times\text{Measured fluidity}) \quad (3)$$

where a1 and b1 are values that vary depending on conditions.

As shown in FIG. 5, under the condition at temperature and humidity of NN and at a "medium" coverage, the correction amount of fluidity is 20% at a standing time of 0 to 12 hours, and is 15% at a standing time of 12 to 24 hours. In contrast, the correction amount of fluidity is 0% at a standing time of 24 hours or longer, and this indicates that the fluidity does not have to be corrected. As is described above, under an identical printing condition, the fluidity increases and the correction amount of fluidity varies with an increasing standing time of 0 to 12 hours, 12 to 24 hours, and 24 hours or longer.

As illustrated in FIG. 6, for example, at a fluidity of about 60%, the external additive amount is about 75% at a standing time of 0 to 12 hours, but decreases down to about 70% at a standing time of 24 hours or longer. Thus, the external additive amount calculator 81 can accurately calculate the external additive amount by applying the corrected fluidity of the developer 70 to Expression (3), where the corrected fluidity has been corrected by the correction amount of fluidity determined according to the printing environment including the standing time, the temperature and humidity, and the coverage.

In the ordinate of the graph in FIG. 6, the external additive amount may be read as the external additive performance. Even in this case, the calculator can determine accurate external additive performance on the basis of the fluidity of the developer 70 according to the printing environment.

Second Method for Calculating External Additive Amount

Next, the second method for calculating the external additive amount will be described with reference to FIG. 7 and FIG. 8.

FIG. 7 is a graph illustrating the relationship between the developing bias and the correction amount of fluidity. The graph is plotted with the abscissa indicating the developing bias (−V), and the ordinate indicating the correction amount of fluidity (%). The relationship between the developing bias and the fluidity as illustrated in FIG. 7 is calculated according to Expression (4) as follows:

$$\text{Fluidity correction amount (\%)}=a2\times\text{Ln(Developing bias)}+b2 \quad (4)$$

where a2 and b2 are values that vary depending on conditions.

As illustrated in FIG. 7, the correction amount of fluidity is about 45% at a developing bias of −600 V; and is about 30% at a developing bias of −400 V. Specifically, the graph demonstrates that, with an increasing charge amount of the toner 71 contained in the developer 70, the fluidity of the developer 70 decreases, and this requires a larger correction amount of fluidity.

In contrast, the graph demonstrates that the correction amount of fluidity is about 0% at a developing bias of −200 V. This indicates that, at such a low developing bias, the toner 71 is charged in a small amount, the developer 70 has high fluidity, and this allows the correction amount of fluidity to be small. The developing bias is a value determined by the controller 100 so as to control the toner mass of coating. Accordingly, the external additive amount calculator 81 can calculate the correction amount of fluidity of the developer 70 according to the developing bias applied to the photoreceptor 41, and can correct the fluidity of the developer 70 by the correction amount of fluidity.

Relationship between Developer Fluidity and External Additive Amount

Figure 8:
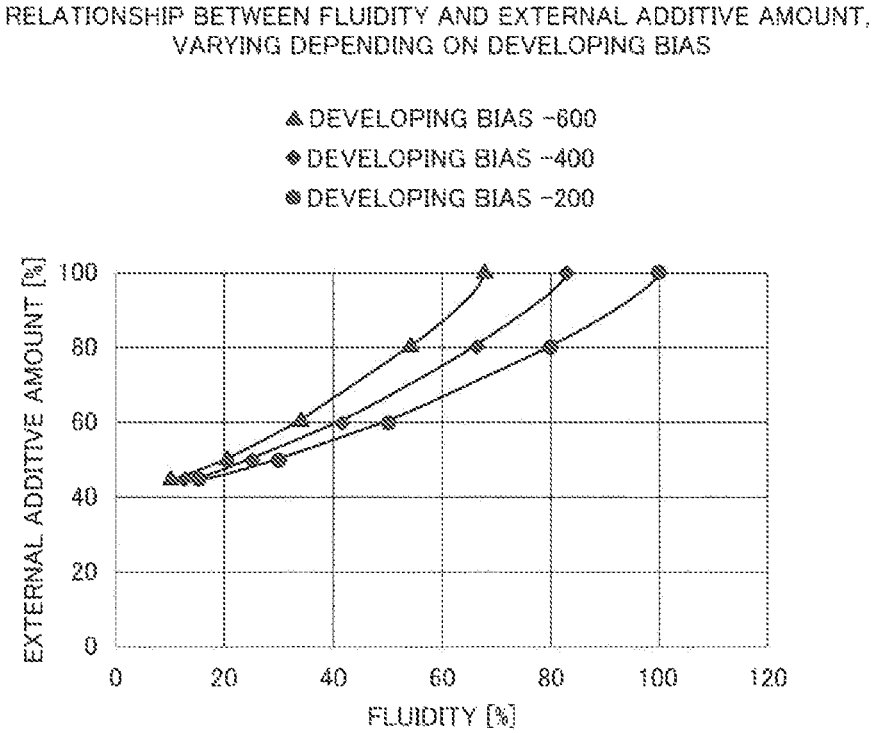
FIG. 8 is a graph illustrating the relationship between the fluidity of the developer and the external additive amount in the first embodiment of the present invention, where the relationship varies depending on the developing bias.

FIG. 8 is a graph illustrating relationships between the fluidity of the developer 70 and the external additive amount at different developing biases. The graph is plotted with the abscissa indicating the fluidity of the developer 70 (%), and the ordinate indicating the external additive amount (%).

FIG. 8 illustrates relationships between the fluidity of the developer 70 and the external additive amount at developing biases of, for example, −200 V, −400 V, and −600 V. The external additive amount is calculated according to following Expression (5), on the basis of the correction amount of fluidity calculated according to the graph in FIG. 7, and on the measured fluidity. Expression (5) indicates that the external additive amount is determined by removing the influence of the toner charge amount from the measured fluidity of the developer 70, as indicated by Expression (2).

$$\text{External additive amount}=a3\times\exp(b3\times\text{Measured fluidity}) \quad (5)$$

where a3 and b3 are values that vary depending on the developing bias.

The graph illustrated in FIG. 8 demonstrates that the fluidity does not have to be corrected under the condition at a developing bias of −200 V; but the correction amount of fluidity increases at an increasing developing bias higher than −200 V. Accordingly, the external additive amount calculator 81 can accurately calculate the external additive amount by correcting the fluidity according to the developing bias, and applying the corrected fluidity to Expression (5).

In the ordinate of the graph illustrated in FIG. 8, the external additive amount may be read as the external additive performance. Even in this case, the calculator can determine accurate external additive performance on the basis of the fluidity of the developer 70 according to the printing environment.

Figure 9:
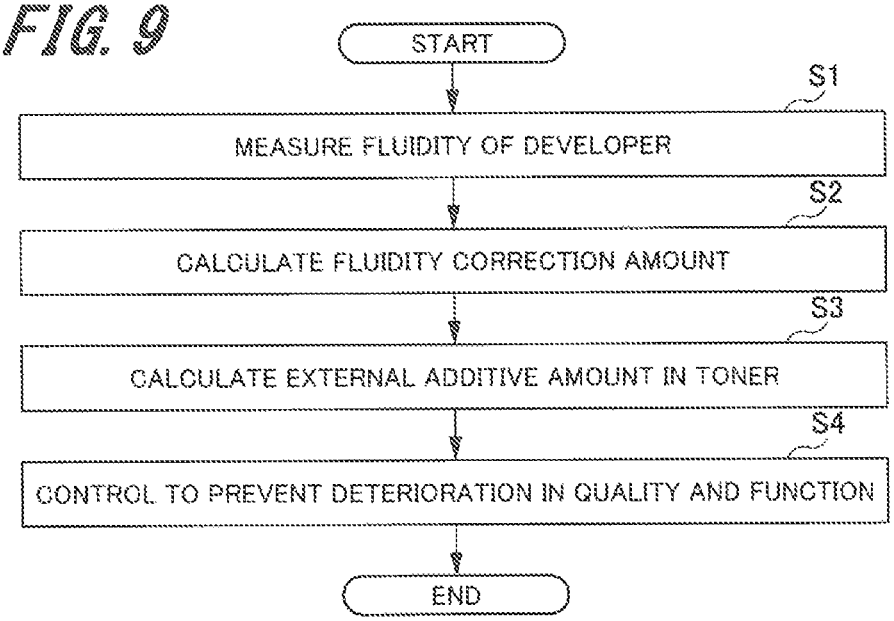
FIG. 9 is a flow chart illustrating how the controller according to the first embodiment of the present invention operates.

FIG. 9 is a flow chart illustrating how the controller 100 operates.

Initially, the supplied-developer fluidity measuring unit 62 measures the fluidity of the developer 70 stored in the supply unit 61, and the discarded-developer fluidity measuring unit 64 measures the fluidity of the developer 70 stored in the discarding unit 63 (S1).

Next, the correction amount calculator 82 calculates the correction amount of fluidity (S2). In this step, the toner charge amount influence corrector 83 corrects the influence of the charge amount of the toner 71 on the fluidity of the developer 70. The isolated-toner fluidity influence corrector 84 corrects the influence of the fluidity of the isolated toner 71 on the fluidity of the developer 70.

Next, the external additive amount calculator 81 corrects the fluidity of the developer 70 on the basis of the correction amount of fluidity, and calculates the external additive amount from the corrected fluidity on the basis of the relationships between the fluidity and the external additive amount as given in FIG. 6 and FIG. 8 (S3).

Next, the deterioration-preventing controller 86 performs predetermined control to eliminate or minimize deterioration in print quality, on the basis of the external additive amount calculated by the external additive amount calculator 81 (S4). In this step, the result output unit 85 may output the calculation result of the external additive amount.

The controller 100 according to the first embodiment as described above corrects the fluidity of the developer 70 by the correction amount of fluidity corresponding to the charge amount of the toner 71 stored in the developing unit 44, and calculates the external additive amount in the toner 71 from the corrected fluidity of the developer 70. The controller can therefore determine the state of the external additive on the basis of the external additive amount in the toner 71. The method according to the present embodiment can therefore more accurately calculate the external additive amount, as compared with conventional methods by which the external additive amount is predicted on the basis of the external environment or specific conditions. Thus, the deterioration-preventing controller 86 can perform appropriate control to eliminate or minimize deterioration on the basis of the external additive amount in the toner 71, which is determined from the corrected fluidity of the developer 70.

Measurement using a color identification sensor as in the conventional technique fails to be performed on a colorless external additive. In contrast, with the present embodiment, the external additive amount calculator 81 can determine the external additive amount in the toner 71 from the fluidity of the developer 70. This enables accurate calculation of an external additive amount regardless of the color of the external additive.

Second Embodiment

Next, a trickle system 60A according to the second embodiment of the present invention will be described.

Figure 10:
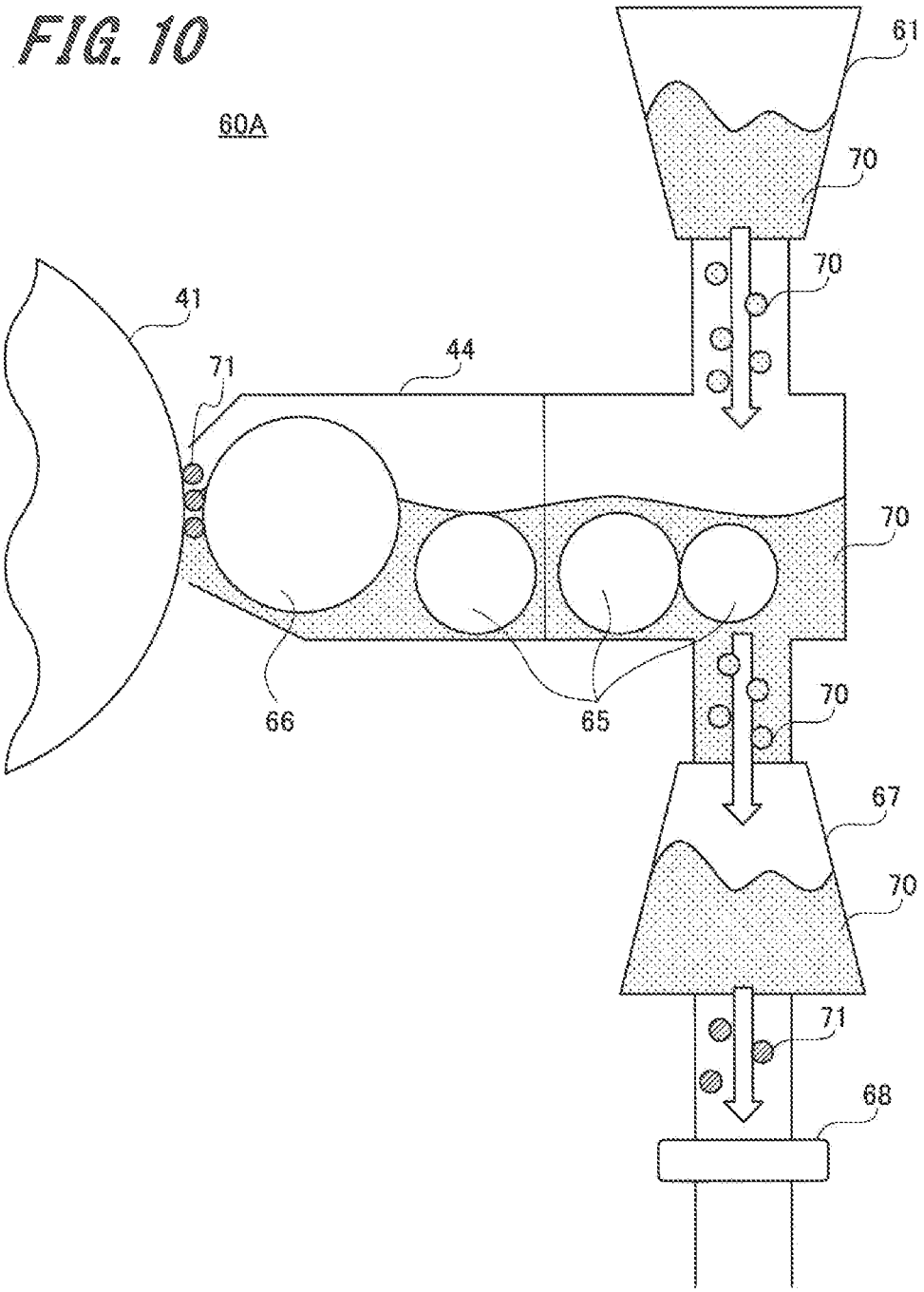
FIG. 10 illustrates an exemplary configuration of a trickle system according to a second embodiment of the present invention.

FIG. 10 illustrates an exemplary configuration of the trickle system 60A.

The trickle system 60A does not include the supplied-developer fluidity measuring unit 62 and the discarded-developer fluidity measuring unit 64 according to the first embodiment, and includes, instead of the discarding unit 63, a toner separating unit 67 and a toner fluidity measuring unit 68 (as an example of fluidity measuring unit).

The toner separating unit 67 separates the toner 71 from the developer 70 discarded from the developing unit 44.

The toner fluidity measuring unit 68 is disposed downstream from the toner separating unit 67 and measures the fluidity of the toner 71 separated by the toner separating unit 67. A method for measuring the fluidity of the toner 71 by the toner fluidity measuring unit 68 is as with any of the methods for measuring the fluidity of the developer 70 by the supplied-developer fluidity measuring unit 62 and the discarded-developer fluidity measuring unit 64 according to the first embodiment.

Figure 11:
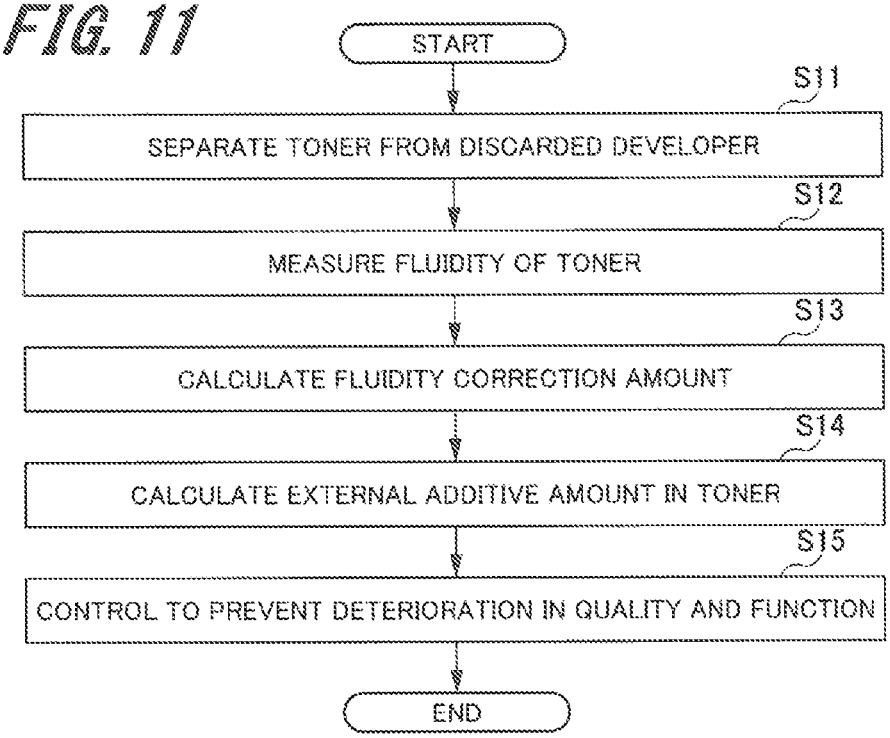
FIG. 11 is a flow chart illustrating how a controller according to the second embodiment of the present invention operates.

FIG. 11 is a flow chart illustrating how the controller 100 operates.

Initially, the toner separating unit 67 separates the toner 71 from the developer 70 discarded from the developing unit 44 (S11). Next, the toner fluidity measuring unit 68 measures the fluidity of the toner 71 (S12). Processes in the downstream steps S13 to S15 are as with the processes in the steps S2 to S4 illustrated in FIG. 9, by which duplicate detailed explanations are omitted.

The trickle system 60A according to the second embodiment, as described above, measures only the fluidity of the toner 71 separated from the discarded developer 70. This informs the external additive amount in the toner 71, and enables accurate correction and control to eliminate or minimize deterioration in quality, where the external additive amount affects the process performance (typically to cause deterioration in transfer rate and/or gloss).

Third Embodiment

Next, a trickle system 60B according to the third embodiment of the present invention will be described.

Figure 12:
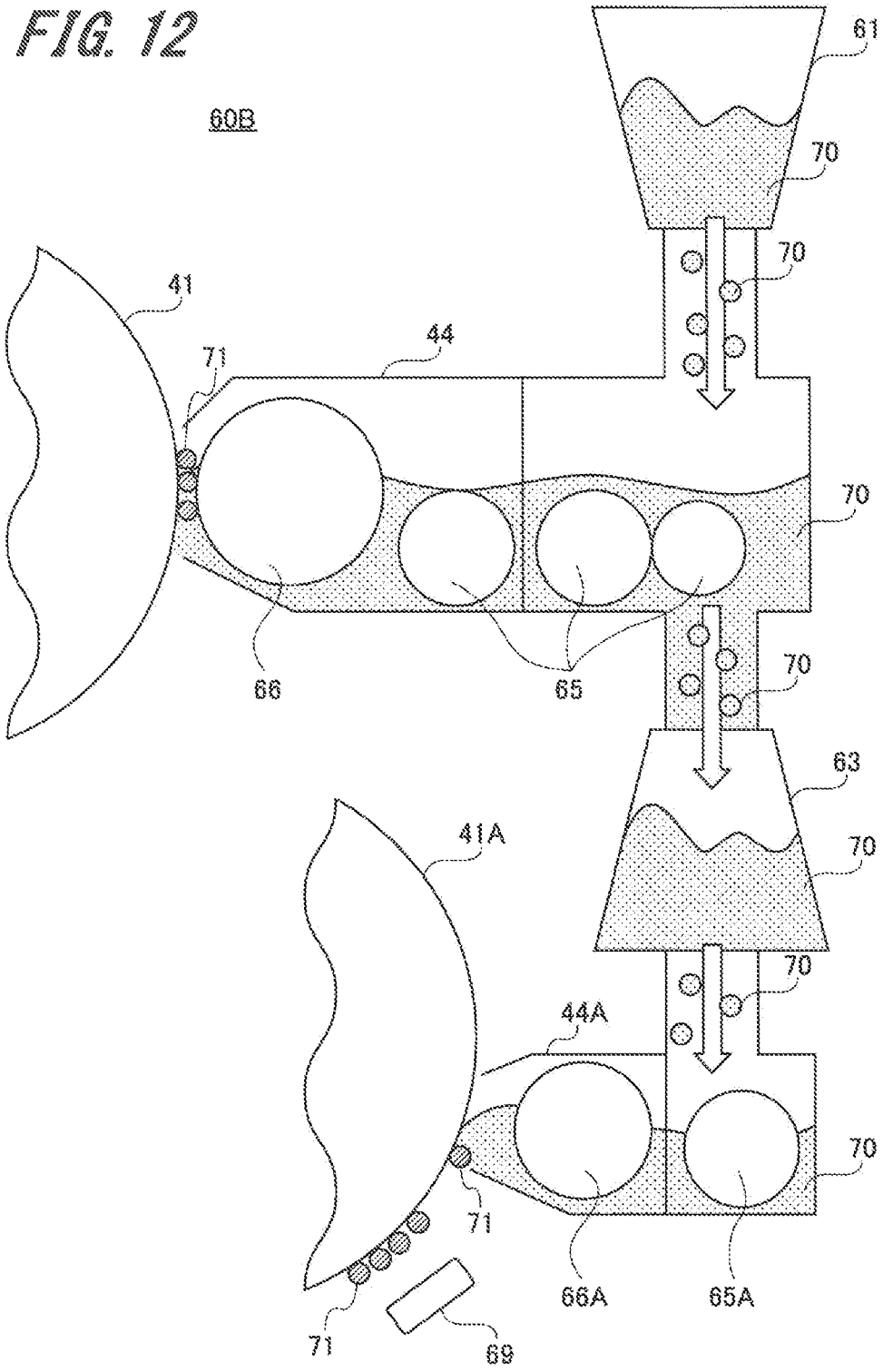
FIG. 12 illustrates an exemplary configuration of a trickle system according to a third embodiment of the present invention.

FIG. 12 illustrates an exemplary configuration of the trickle system 60B.

The trickle system 60B includes a second developing unit 44A coupled to the discarding unit 63, a second photoreceptor 41A, and a toner fluidity measuring unit 69 (as an example of fluidity measuring unit). The trickle system 60B does not include the supplied-developer fluidity measuring unit 62 and the discarded-developer fluidity measuring unit 64 according to the first embodiment.

The discarding unit 63 stores the developer 70 discarded from the developing unit 44. In the second developing unit 44A, the developer 70 stored in the discarding unit 63 travels. The second developing unit 44A includes a supply roller 65A and a developing roller 66A. The supply roller 65A and the developing roller 66A operate respectively as with the supply rollers 65 and the developing roller 66 according to the first embodiment.

The second photoreceptor 41A is rotated clockwise by a driving motor (not shown). To the second photoreceptor 41A, the toner 71 is transferred from the developing roller 66A to form a toner image. Accordingly, the second developing unit 44A is used as an example of a toner separating unit that separates the toner 71 from the developer 70. The second developing unit 44A transfers the toner 71 to the second photoreceptor 41A to form a toner image, where the toner 71 has been separated from the developer 70 discarded to the discarding unit 63.

The toner fluidity measuring unit 69 is disposed adjacent to the second photoreceptor 41A and measures the fluidity of the toner 71 transferred onto the second photoreceptor 41A. In this process, the controller 100 may allow the toner fluidity measuring unit 69 to more easily measure the fluidity of the toner 71 typically by decreasing the voltage of the second photoreceptor 41A. A method for measuring the fluidity of the toner 71 by the toner fluidity measuring unit 69 is as with any of the methods for measuring the fluidity of the developer 70 by the supplied-developer fluidity measuring unit 62 and the discarded-developer fluidity measuring unit 64 according to the first embodiment.

Figure 13:
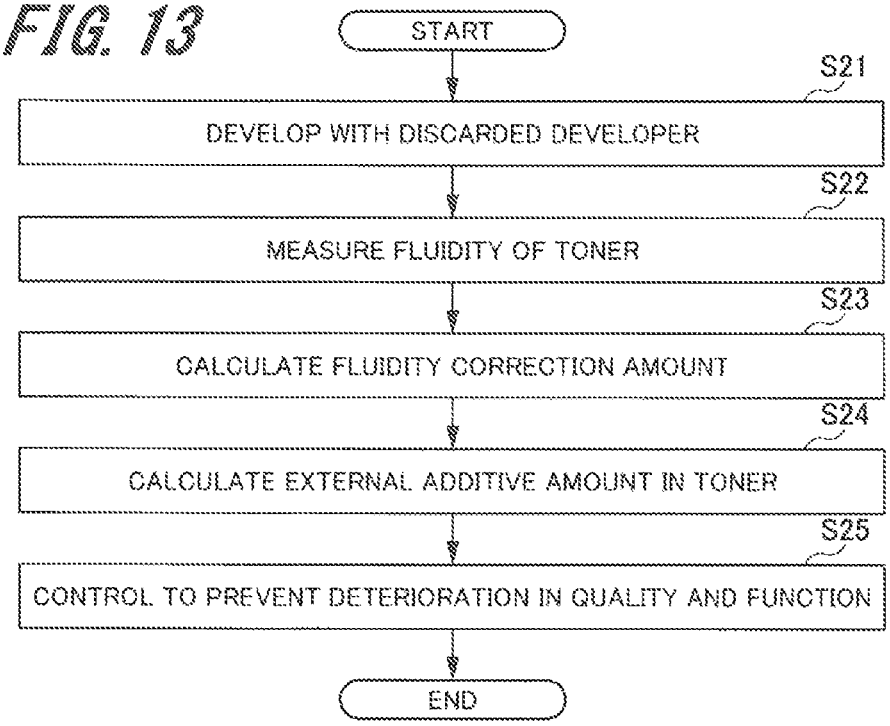
FIG. 13 is a flow chart illustrating how a controller according to the third embodiment of the present invention operates.

FIG. 13 is a flow chart illustrating how the controller 100 operates.

Initially, the second developing unit 44A performs development with the developer 70 discarded from the developing unit 44 (S21). The development by the second developing unit 44A separates the toner 71 from the developer 70 to be discarded. Next, the toner fluidity measuring unit 69 measures the fluidity of the toner 71 transferred onto the second photoreceptor 41A (S22). Processes in the downstream steps S23 to S25 are as with the processes in the steps S2 to S4 illustrated in FIG. 9, by which duplicate detailed explanations are omitted herein.

The trickle system 60B according to the third embodiment, as described above, measures only the fluidity of the toner 71 transferred to the second photoreceptor 41A. This informs the external additive amount in the toner 71 and enables accurate correction and control to eliminate or minimize deterioration in quality, where the external additive amount affects the process performance (typically to cause deterioration in transfer rate and/or gloss).

While embodiments of the present invention have been described and illustrated in detail, it is to be understood that the disclosed embodiments are made for the purposes of illustration and example only, and are never construed to limit the scope of the present invention; that any and all various applications and modifications can be made therein, without deviating from the spirit and scope of the present invention which are delineated in the appended claims; and that the scope of the present invention should be interpreted by terms of the appended claims.

For example, the above-mentioned embodiments have been described on configurations of the apparatus and system in detail and specifically, for the purpose of illustrating the present invention in an easy-to-understood manner. The apparatus and system are not always limited to those including all the configurations described above. Substitution of part of a configuration of one embodiment with a configuration of another embodiment is possible; and addition of a configuration of one embodiment to a configuration of another embodiment is also possible. Further, deletions, as well as additions and substitutions of part of a configuration of each of embodiments in the description with or by another configuration can be made in the present invention.

Of control lines and information lines, those considered to be necessary for description are illustrated; and all the control lines and information lines in the products are not always illustrated. It can be considered that almost all configurations are coupled to each other in practice.

What is claimed is:

1. An image forming apparatus comprising:

a developing unit that transfers toner contained in a two-component developer onto an image bearing member to form a toner image;

a supply unit that supplies the two-component developer to the developing unit;

a fluidity measuring unit that measures fluidity of the two-component developer;

a correction amount calculator that calculates a correction amount of fluidity for correction of the fluidity of the two-component developer: and an external additive amount calculator that:

corrects the fluidity of the two-component developer based on the correction amount of fluidity, where the fluidity of the two-component developer is measured by the fluidity measuring unit;

calculates an amount of an external additive in the toner based on the corrected fluidity of the two-component developer; and determines a state of the external additive.

2. The image forming apparatus according to claim 1, wherein the correction amount calculator calculates the correction amount of fluidity in accordance with a charge amount of the toner.

3. The image forming apparatus according to claim 2, further comprising a discarding unit that stores two-component developer discarded from the developing unit, wherein the fluidity measuring unit is disposed in the discarding unit and calculates a fluidity of the two-component developer discarded from the developing unit.

4. The image forming apparatus according to claim 2, wherein the fluidity measuring unit is disposed in the supply unit and calculates a fluidity of the two-component developer or toner stored in the supply unit, and wherein the correction amount calculator calculates the correction amount of fluidity in accordance with the fluidity of the two-component developer or the toner stored in the supply unit.

5. The image forming apparatus according to claim 2, further comprising a toner separating unit that separates toner from two-component developer discarded from the developing unit, wherein the fluidity measuring unit is disposed in the toner separating unit and measures a fluidity of the toner.

6. The image forming apparatus according to claim 2, further comprising:

a discarding unit that stores two-component developer discarded from the developing unit; and a second developing unit that transfers the toner onto a second image bearing member to form a toner image, where toner has been separated from the two-component developer stored in the discarding unit, wherein the fluidity measuring unit is disposed adjacent to the second image bearing member and measures a fluidity of the toner transferred onto the second image bearing member.

7. The image forming apparatus according to claim 1, wherein the correction amount calculator calculates the correction amount of fluidity in accordance with a printing environment of the two-component developer.

8. The image forming apparatus according to claim 1, wherein the developing unit includes a developing roller, and the correction amount calculator calculates the correction amount of fluidity in accordance with a developing bias applied to the developing roller.

9. The image forming apparatus according to claim 1, further comprising a deterioration-preventing controller that performs control so as to eliminate or minimize deterioration in print quality, where the control is performed based on the state of the external additive determined by the external additive amount calculator and is performed in accordance with a printing environment and a printing condition.

10. The image forming apparatus according to claim 9, wherein the state of an external additive comprises at least one of:

the external additive amount; and external additive performance, wherein the printing environment comprises at least one of:

a standing time for which the two-component developer is left:

internal and external temperatures and humidity of the image forming apparatus; and a coverage, and wherein the printing condition comprises a controlling value of the amount of the toner that adheres to the image bearing member.

* * * * *